United States Patent [19]

Headrick

[11] Patent Number: 4,672,177

[45] Date of Patent: Jun. 9, 1987

[54] ENVIRONMENTAL SENSOR CONTROL OF A HEATED FUSER

[75] Inventor: Michael R. Headrick, Boulder, Colo.

[73] Assignee: International Business Machines Corporation, Armonk, N.Y.

[21] Appl. No.: 797,290

[22] Filed: Nov. 12, 1985

[51] Int. Cl.[4] ..... G03G 15/20

[52] U.S. Cl. ..... 219/216; 355/3 FU; 219/471

[58] Field of Search ..... 219/216, 388, 469, 470, 219/471, 494; 355/3 FU, 14 FU

[56] References Cited

U.S. PATENT DOCUMENTS

| | | | |
|---|---|---|---|
| 3,505,497 | 4/1970 | Lawes et al. | 219/216 |
| 3,677,632 | 7/1972 | MacDonald, Jr. | 355/3 |
| 3,833,790 | 9/1974 | Quant | 219/216 |
| 3,989,370 | 11/1976 | Mooney | 355/14 |
| 4,001,545 | 1/1977 | Wada et al. | 219/216 |
| 4,046,990 | 9/1977 | White | 219/471 |
| 4,104,692 | 8/1978 | Sudo | 219/216 |
| 4,145,599 | 3/1979 | Sakurai et al. | 219/216 |
| 4,259,565 | 3/1981 | Ogino | 219/216 |
| 4,318,612 | 3/1982 | Brannan et al. | 355/14 |
| 4,551,007 | 11/1985 | Elter | 355/14 |
| 4,556,779 | 12/1985 | Hashimoto | 219/471 |
| 4,609,278 | 9/1986 | Taniguchi | 355/3 FU |

FOREIGN PATENT DOCUMENTS

| | | | |
|---|---|---|---|
| 2612282 | 10/1976 | Fed. Rep. of Germany. | |
| 55-77769 | 6/1980 | Japan | 219/216 |
| 57-81278(A) | 5/1982 | Japan . | |
| 988372 | 4/1965 | United Kingdom . | |
| 1092164 | 11/1967 | United Kingdom . | |

*Primary Examiner*—E. A. Goldberg
*Assistant Examiner*—Teresa J. Walberg
*Attorney, Agent, or Firm*—Earl C. Hancock

[57] ABSTRACT

The quality of toner fusing in an electrophotographic or xerographic copier or printer is improved by modifying the reference voltage employed, in conjunction with the fuser hot roll temperature sensing, with a factor correlated to the temperature sensed in the environment of the fuser assembly. In a typical embodiment, the environment temperature is used to develop the reference voltage applied for comparison with the signal from a direct hot roll temperature thermistor. Thus, the temperature set point toward which the hot roll is driven varies as a function of the environment temperature for the fuser assembly.

8 Claims, 8 Drawing Figures

ENVIRONMENTAL SENSOR CONTROL OF A HEATED FUSER

BACKGROUND OF THE INVENTION

1. Field of the Invention

The present invention relates to electrophotographic or xerographic copiers, printers or the like. More particularly, the present invention relates to apparatus and methods for controlling the toner fusing structure in a xerographic or electrophotographic machine so as to improve the quality of the fused toner on produced copy sheets. The present invention is applicable to a wide variety of such toner fusing devices including hot roll fusers, flash fusers, or the like.

2. Description of the Prior Art

The effect of the fuser upon the quality of the final copy in a xerographic or electrophotographic copier/-printer environment is well known. If the temperature of such a fusing device is not carefully controlled, the toner temporarily adhering to the copy sheets as it enters the fuser either fails to properly fuse into the substrate thus causing smearing risk on the final copy, or scorching of the copy sheet results if the fuser temperature is allowed to surpass a maximum.

Various arrangements using a single thermistor to switch to different temperature set points for fuser heater control as a function of the conditions of the machine operation are known. Examples are shown in U.S. Pat. Nos. 4,318,612 by Brannan et al. and 4,145,599 by Sakurai et al. In such devices, the reference voltage associated with a bridge circuit that ultimately controls power application to the fuser heaters is effectively driven by the temperature sensors. U.S. Pat. No. 4,001,545 by Wada et al. uses multiple thermistors, each placed directly on the hot roll, as is well known in the art, but also each used to separately control different heater elements to contour the heat applied to the hot roll.

The use of two thermostats that are serially coupled to the heater element with a relay arranged to cut in the higher temperature thermostat when the copy operation is selected so that serial thermostat operation is realized is shown in U.S. Pat. No. 3,505,497 by Lawes et al.

United Kingdom Patent No. 1,092,164 shows three thermostats for high and low temperature control as well as an intermediate temperature control of an incubator-type device.

United Kingdom Patent No. 988,372 uses dual thermistors coupled into separate legs of a bridge for a freeze-dry type of control.

Japanese patent application No. 55-157096 filed Nov. 10, 1980 (published as 57-81278(A) on May 21, 1982), as understood, suggests using one temperature sensor to completely remove power from the fuser when its environment exceeds a maximum level, and a separate temperature sensor to control heat application to the fuser by sensing the fuser temperature directly. Thus, the Japanese application does not teach improvement of copy sheet quality through fusing temperature control, but is merely a thermal breaker type of operation.

DISCLOSURE OF THE INVENTION

The present invention is apparatus and methods for controlling the heater of a fuser in a xerographic or electrostatic-type device so that the temperature to which the fuser is driven changes as a function of the temperature of the environment around the fuser. The primary objective of this invention is to improve the quality of copy sheets produced from a hot roll fuser in a xerographic/electrophotographic copier, printer or the like.

The primary environment of the present invention is with respect to contemporary heated fuser assemblies. These devices fuse heat softenable material, such as toner, onto a substrate wherein the fuser assembly includes at least one element (usually a roller) arranged for receiving heat from a source. Those having normal skill in the art recognize that the present invention is not necessarily limited to a roll-type fuser assembly even though the preferred embodiment described hereinafter is couched in terms of such an environment.

The fuser device associated with this invention includes means for detecting the fusing temperature of the fuser assembly, and means responsive to the fusing temperature detecting means and a reference signal for selectively actuating the fuser heat source. The improvement in accordance with this invention includes means for sensing the temperature of the environment of the fuser assembly for producing a signal correlated to that environment temperature. An additional means is responsive to this sensing means signal for adjusting the reference signal for the heat source actuating means as a function of the fuser environment.

When used in a machine which includes a hot roll type fuser, the present invention has produced significantly improved copy quality by employing an environmental thermistor located on the main casting of the hot roll fuser in addition to the direct hot roll fuser sensing device. The signal from the environmental sensor is used to add an environment correlated compensation factor to the set point voltage value to which the heated hot roll is driven.

DETAILED DESCRIPTION OF THE PREFERRED EMBODIMENT

The preferred embodiment of this invention is described with respect to a xerographic or electrophotographic type of device which employs hot roll fusers. The basic operation of such apparatus is well known in the art and, thus, the illustration and detailed description thereof in this application is abbreviated. Typical contemporary electrophotographic devices employ a variety of image producing light sources. For example, lasers, light-emitting diodes, scanning optics relative to original documents, microfilm, cathode ray tube, or any of a host of image-producing sources are in use.

Figure 1:
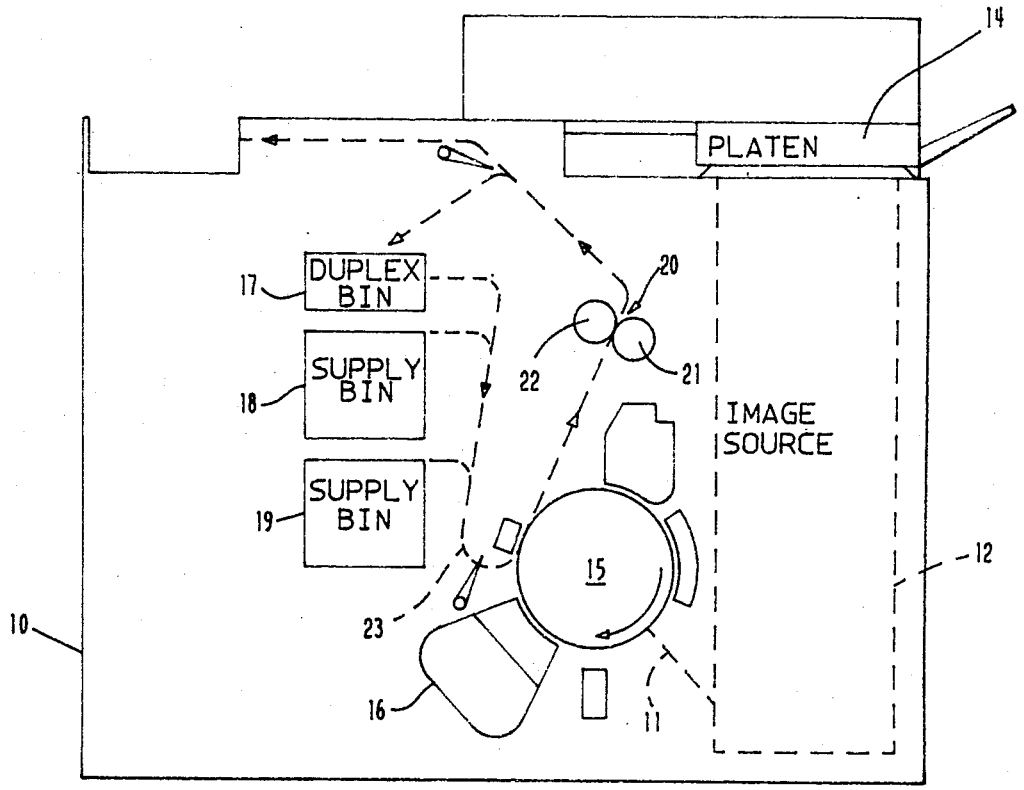
FIG. 1 is a somewhat simplified schematic view of a typical xerographic or electrophotographic copier/-printer.

FIG. 1 shows a partially schematic view of an electrophotographic copier/printer 10. Light rays 11 are produced by source 12 from scanning documents at platen 14, electronic control of a laser printhead, and/or the like. The image from source 12 is exposed to a charged photoconductor surface on drum 15 (although use of a photoconductor belt, or the like, is acceptable) which selectively discharges the photoconductor. Developer 16 causes toner material to adhere to this latent image on the photoconductor. The toner image is subsequently transferred to, and temporarily adheres on, a basic substrate or copy sheet from duplex bin 17 or sheet supply bins 18 or 19.

The copy sheet bearing the toner material is then introduced to a fuser 20, between rolls 21 and 22, from copy sheet paper path 23. The fuser 20 heats the toner to the point where it effectively melts into a permanent copy on the substrate. As mentioned, these hot roll fuser assemblies are well known, and there are many examples in the prior art. For instance, U.S. Pat. No. 4,162,847 by Brandon illustrates considerable detail relative to typical such hot roll fusers, and U.S. Pat. No. 4,436,409 by Queener shows other variations of fusing by means of a flash-type fuser. U.S. Pat. No. 4,318,612 contains some additional detail description of the elements and their interaction in a xerographic or electrophotographic environment similar to FIG. 1.

Copier/printers, such as that shown in FIG. 1, are typically under power and frequently in use throughout each workday. At the end of the workday, usual practice is to turn off the main power switch whereupon all, or at least a majority of, the internal components are deenergized. In every known machine, the heater of the hot roll fuser 20 is deenergized when the main power switch is turned off.

When the main power switch is again turned on, which is usually the morning of the next working day, the copier/printer enters a state of operation during which it readies itself for use. This period may last no more than a few minutes and includes heating the hot roll fuser 20, most often from a room ambient temperature to an operating temperature in excess of 300 degrees Fahrenheit. After the initial wait period of approximately ten minutes, the copier indicates to the user that it is available for use, and enters a standby mode. Thereafter, the machine is placed in use by introducing original documents to the machine either manually or by a document feeder and/or by activating the light source printhead electronics.

Figure 2:
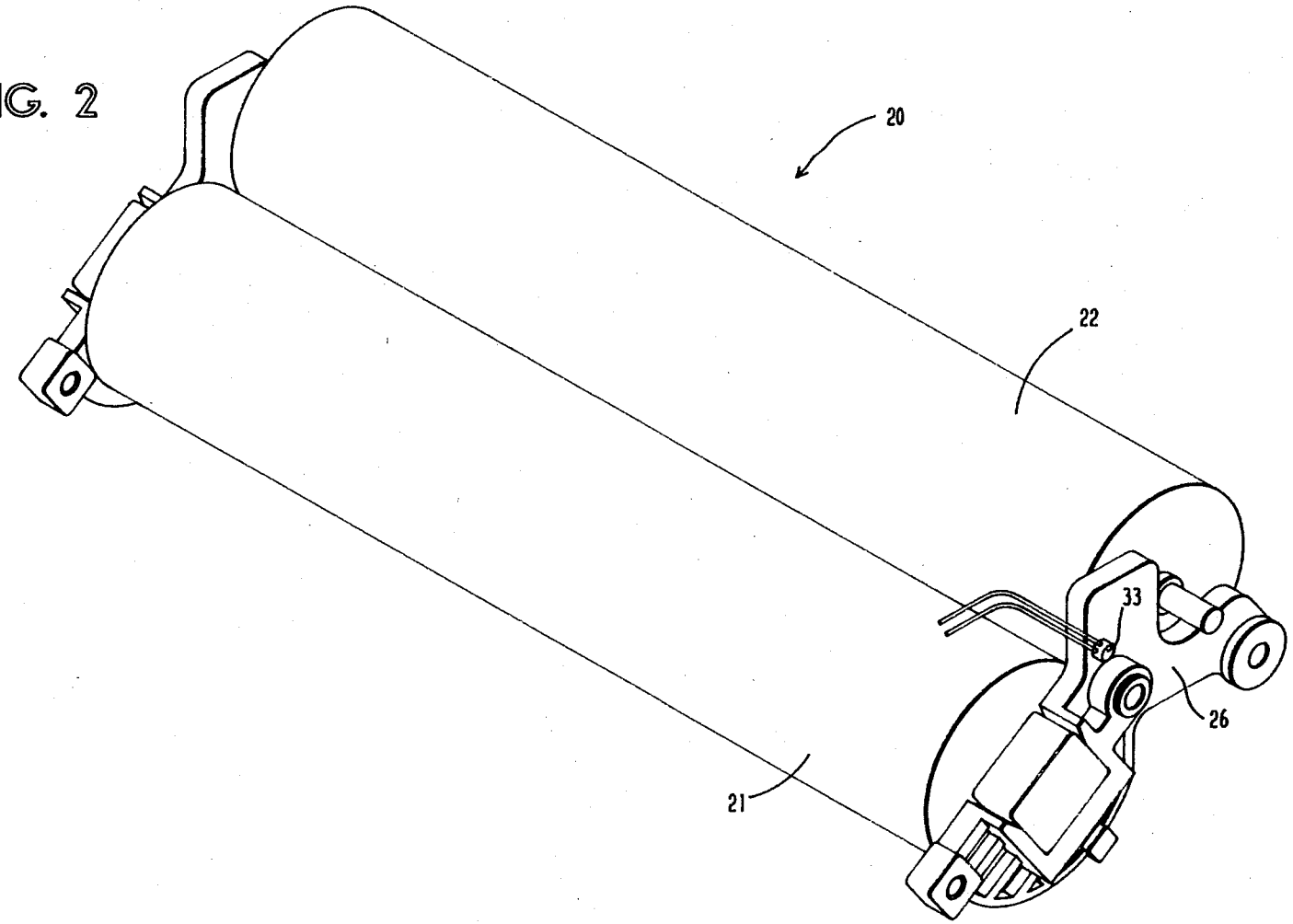
FIG. 2 is an isometric view of hot roll fuser components in a typical environment illustrating a preferred location of the environmental sensor.
Figure 3:
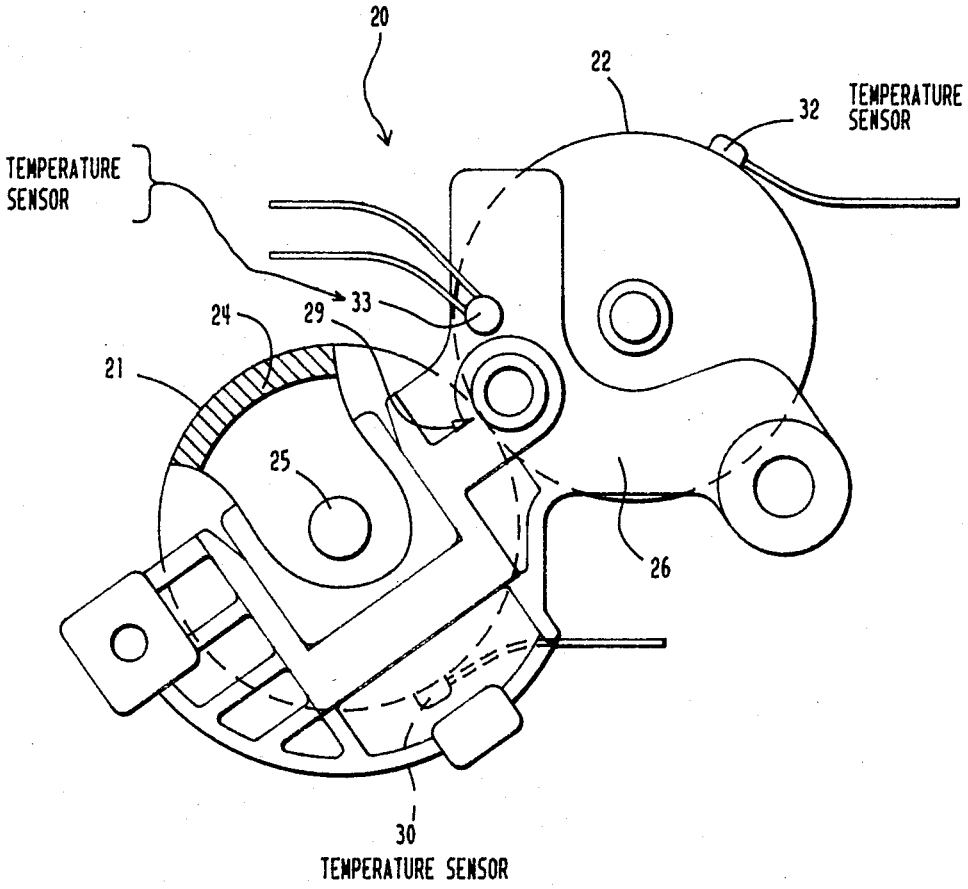
FIG. 3 is a close-up end view illustrating sensor positions in FIG. 2.

The present invention is best understood from FIGS. 2–5. FIGS. 2 and 3 disclose a hot roll fuser assembly 20 including components useful in conjunction with the present invention. The hot roll 21 consists of a metallic core 24 covered by a deformable elastomeric coating. Hot roll 21 is heated by internal lamp 25 (note FIG. 3). Fuser assembly 20 also contains a hard metallic backup roll 22, which is constrained by support member 26, and is forced so as to compress the elastomer coating of hot roll 21 by a spring assembly (not shown). The action of backup roll 22 against the elastomeric coating forms the fusing nip 29 in which toner is permanently affixed to the paper as it passes through nip 29.

As is discussed in greater detail later herein in conjunction with the circuitry shown in FIG. 5, the temperature of the hot roll 21 is controlled by a comparison network which uses the electrical signal from a conventionally placed temperature sensor 30 mounted in direct contact with hot roll core 24. Basically, the comparison network compares the actual temperature of the hot roll core 24 to a control point temperature also referred to as the command temperature. If the actual temperature is lower than the command temperature, the fuser heater 25 is energized in a manner best suited to achieve the command temperature in a short time interval, but without excessive overshoot by the fuser's actual temperature. Such hot roll temperature control systems are conventional, and a variety of control schemes are available to those normally skilled in the art which minimize both time and overshoot in such an operating environment. The use of a particular hot roll temperature control system is a matter of design choice, and is not critical to the present invention.

The command temperature of the fuser 20 is chosen such that the heat from the hot roll 21 softens the particulate toner to fuse it to the paper to form a permanent image. The appropriate command temperature depends on a number of parameters, such as the melting point of the toner, the pressure in the fusing nip, the time required to travel through the fusing nip, the quantity of toner on the copy, the size of the paper, the size of the toner particles, the temperature of the paper, and the temperature of the surrounding fuser hardware, especially the temperature of the backup roll 22.

Some of the aforementioned parameters vary throughout the day and, for optimum operation, the command temperature should likewise vary throughout the day. In accordance with the present invention, the temperature of the pertinent hardware is actively monitored by a temperature sensor, and the command temperature is adjusted during operation of the machine. For example, after an extended period with the copier off (e.g., overnight), all components at fusing station 20 are at ambient room temperature. Under these conditions, the command temperature for the hot roll 21 requires increasing to compensate for the environmental temperature from the cool surrounding hardware. Conversely, after the machine is powered on for an extended period of time, all components of fuser station 20 become warm because of their proximity to the heated hot roll 21. Thus fusing of toner is aided by the warm surroundings, and a lower command temperature for hot roll 21 is all that is needed.

The temperature of the surrounding hardware is measurable with any temperature transducer which has an electrical output, such as a thermistor or thermocouple. This transducer is located at a convenient point on the surrounding hardware of fuser assembly 20 with the point chosen such that variations in its temperature influence the fusing quality. Ideally, the environmental sensor should contact the rotating backup roll 22, as shown by transducer 32 in FIG. 3, as the backup roll temperature most directly influences fusing quality. Alternatively, it is acceptable to mount the sensor on a stationary member, as illustrated by sensor 33 in FIGS. 2 and 3, on bracket or frame member 26 for practical convenience of installation and reliability of operation. If desired, it is possible to use an average of the two sensors 32 and 33 as the environmental temperature, or to use sensor 33 as an operational check and/or backup to sensor 32 or vice versa.

Figure 6:
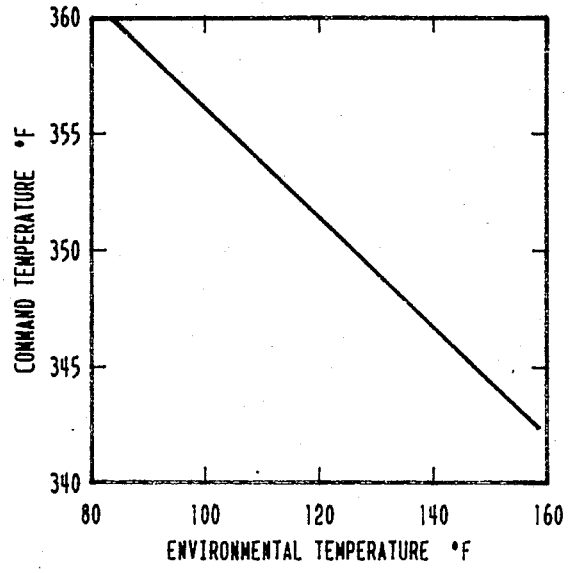
FIG. 6 is a graph showing the shift of command temperature as a function of the hot roll environment temperature in accordance with this invention.

The electrical output signal from environmental sensor 32 or 33 is used by the machine control logic to adjust the command temperature of the hot roll 21. The proper algorithm for adjusting the command temperature in response to the environmental temperature will vary with details of implementation. For purposes of illustration, one such algorithm is presented in FIG. 6 in graphical form. In this particular example, the graph represents the equation:

$$\text{Command Temp.} = 380.8 - (0.243 \times \text{Env. Temp.})$$

where Env. Temp. is the environmental temperature at the fuser assembly 20 as from sensor 32 or 33 or a combination thereof and 0.243 is a constant developed by first placing the environmental sensor in various locations to determine the optimum fusing location and thereafter performing a series of quality tests on copies fused at various environmental temperatures thereby permitting a straight-line calculation of the compensating constant from the measurements associated with the aforesaid optimum location.

The 0.243 constant was thus determined as optimum for the IBM Series III Models 30, 40 and 60 Copier/Duplicator machines. Also, the constant 380.8 applies to the aforementioned machines based on the circumstances wherein the environmental sensor has the least significance (e.g., a cool or start-up environment), and will vary depending upon the particular type of fuser used. The constants are determined for any given machine by a relatively simple sequence of tests comprised of placement of the environmental sensor in various locations followed by performance of conventional fusing quality tests to select the optimum location of the environmental sensor for the particular machine under test. The algorithms will have the common feature that cooler environmental temperatures will require hotter command temperatures, and hotter environmental temperatures will require cooler command temperatures.

As mentioned, the optimum location for the environmental sensor will vary for different machines. Therefore, the best location for this sensor is determined for a particular species of machine by a series of tests. Theoretically, it is best to monitor the backup roll temperature, but this is often impractical since the backup roll rotates. Determination of the optimum sensor is possible by the following procedure:

1. Mount a plurality of thermocouples or the like in different positions in the fuser environment.
2. Monitor the thermocouple temperatures for a period adequate to ensure temperature stability in the fuser area (e.g., minimum of two hours after powering on the machine).
3. Take fusing samples at regular intervals (e.g., every ten minutes), and perform quality tests thereon. These fusing quality tests are well known, such as rub resistance tests, erasure resistance tests and crease resistance tests.
4. Compare fusing quality with temperature measurements.
5. Choose the sensor location that produced data that most closely correlates with fuse quality variation over a period of time. Mount the environmental sensor at that location. As seen in FIGS. 2 and 3, it was found, for the machine shown, that use of a sensor at position 33 was best as it is stationary and out of the way while still producing data plots closely correlated to fusing quality.

The logic for generating the command temperatures can take a wide variety of forms including discrete components, such as differential amplifiers, discrete logic components and microcomputers.

Figure 4:
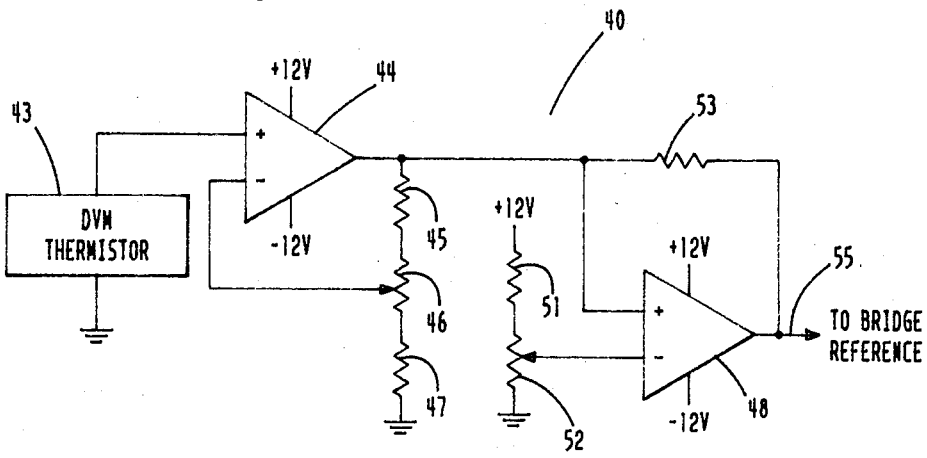
FIG. 4 is a schematic diagram of a scaling circuit for factoring the environmental temperature sensor output into the set point control.
Figure 5:
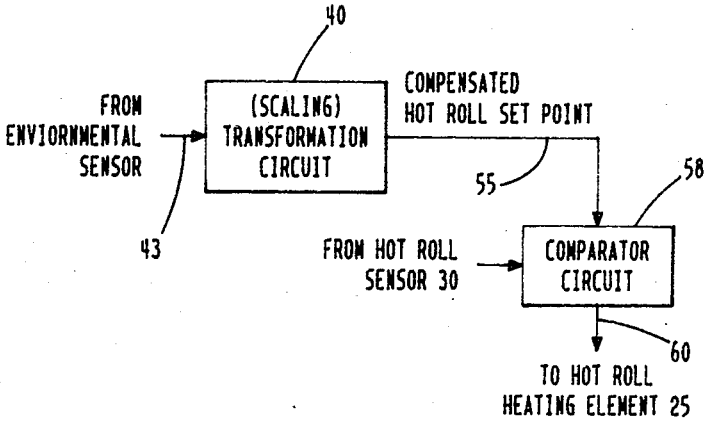
FIG. 5 is a system diagram illustrating utilization of the reference signal produced by scaling circuitry, such as FIG. 4, to control the power applied to the heated hot roll of a FIG. 1 type embodiment.

A scaling or transformation circuit is shown in FIG. 4 to accommodate the compensatory constants and a block diagram of a typical system organization utilizing the FIG. 4 compensation to accomplish the desired result is shown in FIG. 5. In FIG. 4, the environmental sensor 43 (corresponding to 32 or 33 in FIG. 3) provides one input to differential amplifier 44. A resistive divider circuit is composed of variable resistor 46 (to allow for adjustment of the environmental constant, such as 0.243 of the previous equation) and fixed resistors 45 and 47. The resultant signal provides one input to amplifier 48. The other input to amplifier 48 is provided by fixed resistor 51 and variable resistor 52 which allows for the appropriate adjustment of the uncompensated input.

FIG. 5 shows the system configuration that employs the FIG. 4 circuit output 55 which represents the compensated hot roll set point. As discussed above, circuit 40 of FIG. 4 accepts environmental input signal 43 to produce the compensated hot roll set point output 55. This provides one input to comparator circuit 58. Circuit 58 combines signal 55 with the signal from direct hot roll sensor 30 to energize the hot roll heater 25 in response to output 60. The functions of FIG. 5 are obtainable through use of analog-to-digital/digital-to-analog circuits providing input and output to a computer or other programmed device as those skilled in the art will recognize.

One example of values for the FIG. 4 circuit are as follows: Thermistor 43 is a Wahl DVM thermistor which has an output of 1 MV/Degree C., amplifier 44 is a CA 3140, resistors 45–47 are 25.5K, 5K and 10K respectively, amplifier 48 is a 741, resistor 51 is 10K, and resistor 52 is 2K ohms.

Figure 7:
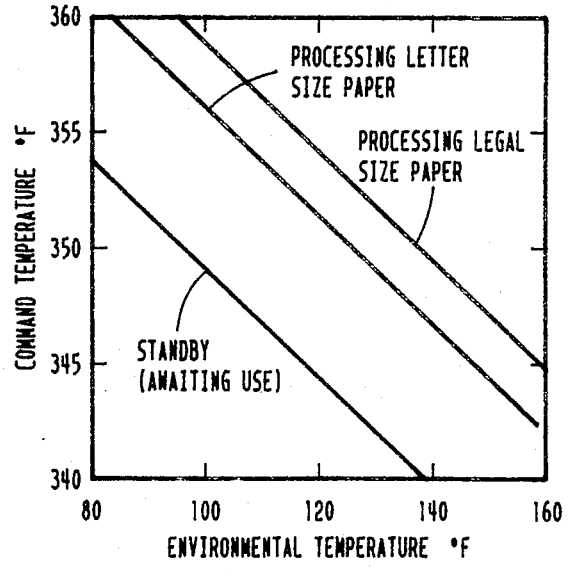
FIG. 7 is a graph illustrating the command temperature to environment temperature relation which account for additional machine operation status.

The logic for generating the command temperature may also consider other information, such as the job size and paper size as shown in FIG. 7. In this example, different command temperature curves are used to establish the command temperature depending upon whether the machine is in standby awaiting a job, processing a job using legal size paper or processing a job using letter size paper. At the end of a job, or in anticipation of the actual job end, the logic changes back to the command curve for standby.

Figure 8:
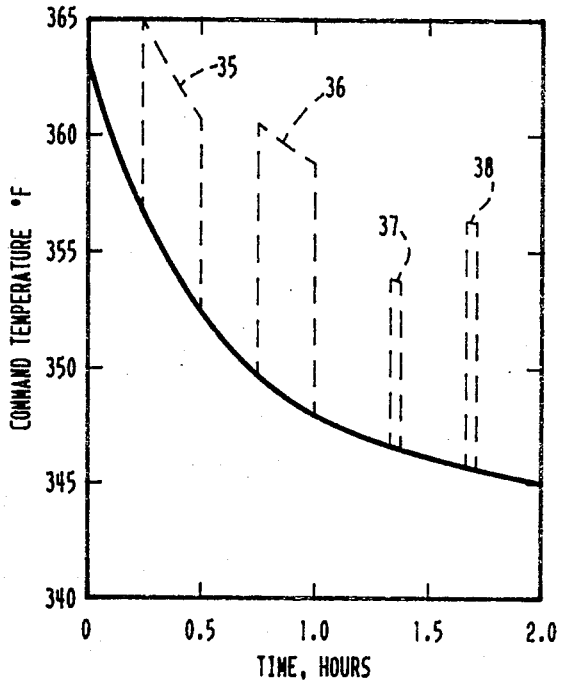
FIG. 8 shows a typical command temperature shift as a function of time, and includes an illustration of the effects of machine operation of different lengths.

Using such a temperature control logic will result in a plot of command temperature versus time, as shown in FIG. 8. This plot starts when the copier or printer machine is turned on after an extended power-off period. Initially, the fuser surrounding hardware is cool. Thus, to compensate, the control logic sets a high command temperature. As the temperature of the surrounding hardware increases, the command temperature decreases. Periodically, the command temperature is changed when a job is run, as illustrated by curve 35 for a relatively long job on letter sized paper, by curve 36 for a long job on legal sized paper, by curve 37 for a short job on letter paper, and by curve 38 for a short job on legal paper, all as time passes.

The foregoing detail description of the preferred embodiments are exemplary only. Those having normal skill in the art will recognize various changes, additions, and deletions within the scope of the description and appended claims.

What is claimed is:

1. In a device having a fuser assembly for fusing a heat softenable material onto a substrate wherein the fuser assembly includes at least one element arranged for receiving heat from a source;

means for detecting the fusing temperature associated with the heated element of the fuser assembly, and means responsive to the fusing temperature detecting means and a reference signal for selectively actuating the fuser heat source, an improvement comprising:

means sensing the temperature of the environment of the fuser assembly for producing a signal correlated to said environment temperature; and means responsive to said sensing means signal for establishing the reference signal for said heat source actuating means.

2. An improved device in accordance with claim 1 wherein said means responsive to said sensing means increases and decreases the magnitude of said reference signal whenever said sensing means signal indicates the environment temperature of said fuser assembly is decreasing and increasing, respectively.

3. An improved device in accordance with claim 2 wherein said means responsive to said sensing means changes the magnitude of said reference signal in accordance with the equation:

$$\text{Command Temp.} = K1 - (K2 \times \text{Env. Temp.})$$

where Command Temp. is the set point signal corresponding to said reference signal, Env. Temp. is the environmental temperature detected by said sensing means, K1 is a constant corresponding to the maximum command temperature for said heated fuser element, and K2 is a constant for converting Env. Temp. to a value correlated to the optimum Command Temp. for the best quality of fusing of said heat softenable material.

4. In an electrophotographic device having a toner fusing assembly including a hot roll, a heater for said hot roll, a backup roll, and a first temperature sensor for producing an output signal indicative of the hot roll temperature, means comparing said first sensor output signal against a set point reference signal for selectively activating said hot roll heater, an improvement comprising:

a second temperature sensor;

means mounting said second sensor for detecting the environmental temperature relative to said backup roll and for producing an output signal indicative thereof; and means responsive to said second sensor output signal for adjusting said set point reference signal as a function of the environmental temperature for said backup roll;

whereby said hot roll has heat applied thereto for causing the hot roll to assume a temperature for optimum toner fusing regardless of the length of time of operation and variations in workload demand for the device.

5. An improved device in accordance with claim 4 wherein said set point adjusting means includes means for increasing and decreasing said set point reference signal in response to decreases and increases, respectively, of said backup roll environmental temperature.

6. An improved device in accordance with claim 5 wherein said adjusting means controls said set point reference signal in accordance with the equation:

$$\text{Command Temp.} = K1 - (K2 \times \text{Env. Temp.})$$

where Command Temp. is said set point reference signal, Env. Temp. is the environmental temperature detected by said second sensor, K1 is a constant corresponding to the maximum command temperature for said fuser hot roll, and K2 is a constant for converting Env. Temp. to a value correlated to the optimum Command Temp. for best quality toner fusing.

7. A method of continuously controlling the fusing temperature of an electrically energizable fuser as a function of the ambient temperature of the environment in which said fuser is operating, comprising the steps of:

establishing a desired fusing temperature as a command fusing temperature;

substantially continuously sensing said fusing temperature;

substantially continuously sensing said ambient temperature;

comparing said command fusing temperature to said sensed fusing temperature;

energizing said fuser in response to said comparing step so long as said fusing temperature is lower than said command temperature; and modifying said established command fusing temperature as a function of said sensed ambient temperature.

8. A method in accordance with claim 7 which includes the steps of shifting said established command fusing temperature in relation to the anticipated fusing demand on said fuser.

* * * * *